US006098404A

United States Patent [19]

Armstrong

[11] Patent Number: 6,098,404

[45] Date of Patent: Aug. 8, 2000

[54] LIQUID/VAPOR CYCLE

[75] Inventor: William Armstrong, 10349 Highway 30, Clatskanie, Oreg. 97016

[73] Assignee: William Armstrong, Juneau, Ak.

[21] Appl. No.: 09/111,701

[22] Filed: Jul. 8, 1998

[51] Int. Cl.[7] ..... F03C 5/00

[52] U.S. Cl. ..... 60/531; 417/379

[58] Field of Search ..... 60/531; 417/379

[56] References Cited

U.S. PATENT DOCUMENTS

| | | | |
|---|---|---|---|
| 2,039,999 | 5/1936 | Holyfield | 417/379 |
| 2,884,866 | 5/1959 | Patterson | 417/379 |
| 2,976,675 | 3/1961 | Bonner | 60/531 |
| 3,604,822 | 9/1971 | Soxe | 60/531 |

FOREIGN PATENT DOCUMENTS

| | | | |
|---|---|---|---|
| 3232497 | 2/1983 | Germany | 60/531 |
| 877143 | 10/1981 | U.S.S.R. | 431/379 |

*Primary Examiner*—Noah P. Kamen

[57] ABSTRACT

An engine is provided including a heat exchanger capable of providing a first temperature and a second temperature, wherein the first temperature and the second temperature are different so as to define a temperature differential. A component of the engine includes a chamber with liquid/vapor therein. In use, the heat exchanger is capable of subjecting the chamber to the first temperature source and the second temperature source in a reciprocating manner for affording a change in pressure which may be harnessed as work output.

4 Claims, 3 Drawing Sheets

LIQUID/VAPOR CYCLE

LIQUID/VAPOR CYCLE

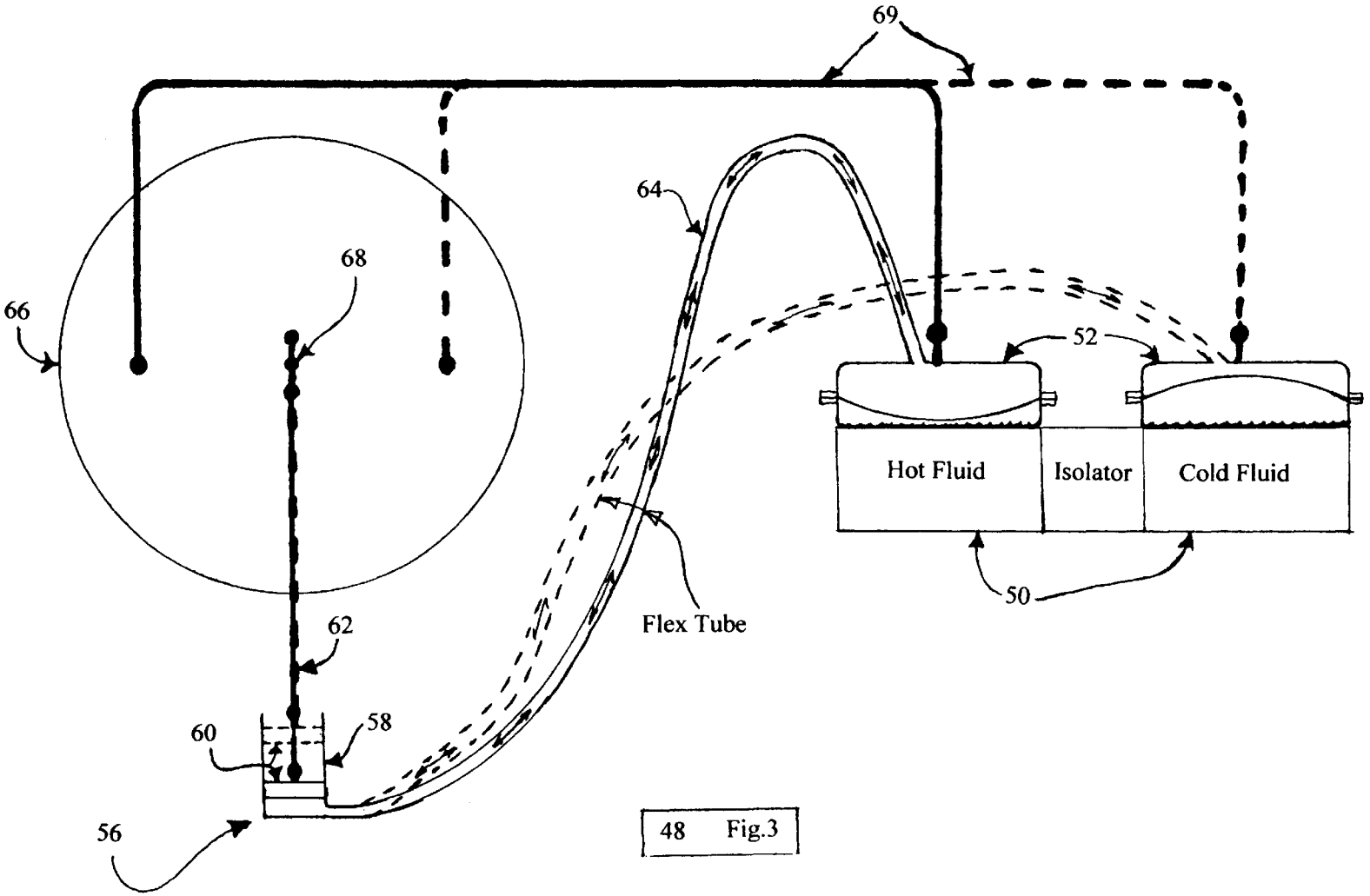
LIQUID/VAPOR CYCLE
48 Fig.3

Pressure Temperature Chart For: Forane R 123

| Temp (°F) | 123 psig | 11 psig |
|---|---|---|
| -40 | * 28.8 | * 28.4 |
| -30 | * 28.3 | * 27.8 |
| -20 | * 27.8 | * 27.1 |
| -10 | * 26.9 | * 26.0 |
| 0 | * 25.9 | * 24.7 |
| 10 | * 24.5 | * 23.1 |
| 20 | * 22.8 | * 21.1 |
| 30 | * 20.7 | * 18.6 |
| 40 | * 18.1 | * 15.6 |
| 50 | * 14.9 | * 12.0 |
| 60 | * 11.1 | * 7.7 |
| 70 | * 6.5 | * 2.6 |
| 80 | * 1.2 | 1.6 |
| 90 | 2.5 | 5.0 |
| 100 | 6.2 | 8.9 |
| 110 | 10.4 | 13.4 |
| 120 | 15.2 | 18.5 |
| 130 | 20.8 | 24.3 |
| 140 | 27.0 | 30.8 |
| 150 | 34.2 | 38.1 |
| 160 | 41.6 | 46.2 |
| 170 | 51.0 | 55.3 |
| 180 | 60.9 | 65.3 |
| 190 | 71.9 | 76.3 |
| 200 | 84.0 | 88.4 |

** Pressures provided in Inches Mercury Vacuum.*

| Temp (°F) | psia | Density (lb./cu. ft.) | | Enthalpy (BTU/lb.) | |
|---|---|---|---|---|---|
| | | Liquid | Vapor | Liquid | Vapor |
| -40 | 0.545 | 101.1 | 0.0186 | 0.00 | 84.77 |
| -30 | 0.776 | 100.3 | 0.0259 | 4.35 | 86.14 |
| -20 | 1.09 | 99.49 | 0.0354 | 6.51 | 87.51 |
| -10 | 1.49 | 98.70 | 0.0477 | 8.69 | 88.89 |
| 0 | 2.01 | 97.91 | 0.0632 | 10.89 | 90.28 |
| 10 | 2.68 | 97.11 | 0.0826 | 13.11 | 91.68 |
| 20 | 3.52 | 96.30 | 0.1065 | 15.35 | 93.09 |
| 30 | 4.56 | 95.49 | 0.1358 | 17.61 | 94.50 |
| 40 | 5.85 | 94.67 | 0.1711 | 19.89 | 95.91 |
| 50 | 7.40 | 93.84 | 0.2134 | 22.20 | 97.32 |
| 60 | 9.28 | 93.00 | 0.2636 | 24.52 | 98.74 |
| 70 | 11.51 | 92.15 | 0.3228 | 26.86 | 100.16 |
| 80 | 14.15 | 91.29 | 0.3919 | 29.22 | 101.57 |
| 90 | 17.24 | 90.41 | 0.4723 | 31.61 | 102.98 |
| 100 | 20.84 | 89.52 | 0.5651 | 34.01 | 104.39 |
| 110 | 25.01 | 88.62 | 0.6717 | 36.44 | 105.79 |
| 120 | 29.79 | 87.69 | 0.7935 | 38.89 | 107.18 |
| 130 | 35.25 | 86.75 | 0.9323 | 41.37 | 108.56 |
| 140 | 41.45 | 85.79 | 1.0900 | 43.87 | 109.93 |
| 150 | 48.45 | 84.80 | 1.2670 | 46.39 | 111.29 |
| 160 | 56.32 | 83.79 | 1.4680 | 48.94 | 112.64 |
| 170 | 65.12 | 82.75 | 1.6930 | 51.52 | 113.97 |
| 180 | 74.93 | 81.69 | 1.9460 | 54.13 | 115.28 |
| 190 | 85.81 | 80.59 | 2.2290 | 56.76 | 116.56 |
| 200 | 97.83 | 79.45 | 2.5460 | 59.43 | 117.83 |

To calculate the Latent Heat of Vaporization, subtract the liquid enthalpy from the vapor enthalpy at the desired temperature.

Temperature Conversion: °C = (°F − 32) x 5/9

Pressure Conversion: psig = psia − 14.7 {P > 14.7}
in. Hg Vacuum = (14.7 − psia) x 2.036

Density Conversion: lb./cu. ft. {water = 62.43 lb./cu. ft.}
lb./gal. = lb./cu. ft. ÷ 7.48 {water = 8.35 lb./gal.}
g/ml = lb./cu. ft. x 0.016 {water = 1 g/ml}

Fig.4

LIQUID/VAPOR CYCLE

BACKGROUND OF THE INVENTION

1. Field of the Invention

The present invention relates to a liquid/vapor cycle and more particularly pertains to harnessing the ability of liquid's vapor pressure to change rapidly, even with a modest temperature change in the order of 10–20 degrees F.

2. Description of the Prior Art

The use of work-producing energy transfer cycles is known in the prior art. More specifically, energy transfer cycles heretofore devised and utilized for the purpose of producing a work output given a change in temperature are known to consist basically of familiar, expected and obvious structural configurations, notwithstanding the myriad of designs encompassed by the crowded prior art which have been developed for the fulfillment of countless objectives and requirements.

By way of example, the prior art includes the well-documented Stirling cycle.

In this respect, the liquid/vapor cycle according to the present invention substantially departs from the conventional concepts and designs of the prior art, and in so doing provides an apparatus primarily developed for the purpose of harnessing the ability of liquid's vapor pressure to change rapidly, even with a modest temperature change in the order of 10–20 degrees F.

Therefore, it can be appreciated that there exists a continuing need for a new and improved liquid/vapor cycle which can be used for harnessing the ability of liquid's vapor pressure to change rapidly, even with a modest temperature change in the order of 10–20 degrees F. In this regard, the present invention substantially fulfills this need.

SUMMARY OF THE INVENTION

In view of the foregoing disadvantages inherent in the known types of energy transfer cycles now present in the prior art, the present invention provides an improved liquid/vapor cycle. As such, the general purpose of the present invention, which will be described subsequently in greater detail, is to provide a new and improved liquid/vapor cycle which has all the advantages of the prior art and none of the disadvantages.

To attain this, the present invention essentially comprises an engine, pump or the like with a heat exchanger capable of taking on a first temperature and a second temperature. Next provided is a chamber with liquid/vapor therein which acts as a working fluid. In use, the heat exchanger is adapted for subjecting the chamber to the first temperature and the second temperature in a reciprocating manner. This reciprocation of temperature effects a change in pressure which may, in turn, be used to move a piston, diaphragm or the like such that energy may be harnessed and work output generated.

It should be noted that in the context of the present description, the liquid/vapor refers to a mixture of liquid and a vapor form of such liquid. An amount of the liquid must be sufficient enough to effect the complete stroke of the piston or diaphragm while still leaving a minimal amount of liquid within the chamber so as to effect the reciprocation of the process. The critically of this amount will become more clear hereinafter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved liquid/vapor cycle which has all the advantages of the prior art energy transfer cycles and none of the disadvantages.

Still yet another object of the present invention is to provide a new and improved liquid/vapor cycle which provides in the apparatuses and methods of the prior art some of the advantages thereof, while simultaneously overcoming some of the disadvantages normally associated therewith.

It is another object of the present invention to provide a new and improved liquid/vapor cycle which may be easily and efficiently manufactured and marketed.

It is a further object of the present invention to provide a new and improved liquid/vapor cycle for harnessing of low to moderate thermal energy(i.e. solar geothermal, waste heat, naturally occurring sources such as ocean thermal currents, temperature differences of air vs. water, hot air vs. cold air, hot water vs. cold water, etc.

An even further object of the present invention is to provide a new and improved liquid/vapor cycle for employing cold and hot liquid/vapor as opposed to cold and hot air as a working fluid.

Lastly, another object of the present invention is to harness the ability of liquid's vapor pressure to change rapidly, even with a modest temperature change in the order of 10–20 degrees F.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic diagram of yet another embodiment of the present invention.

FIG. 4 is a chart of an example liquid/vapor which may be employed under certain conditions.

Similar reference characters refer to similar parts throughout the several views of the drawings.

DESCRIPTION OF THE PREFERRED EMBODIMENT

Figure 1:
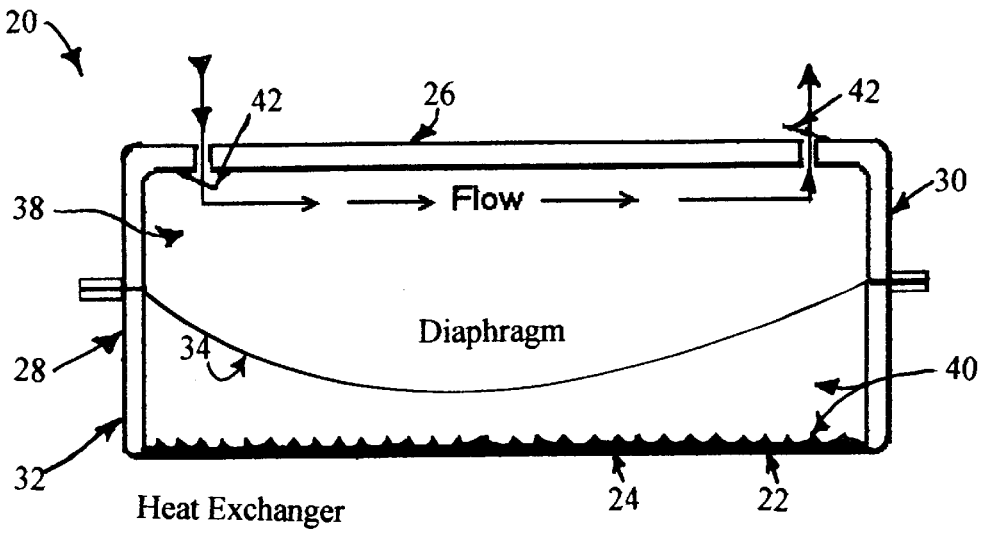
FIG. 1 is a front cross-sectional view of a pump embodiment of the present invention with heat being extracted from the liquid/vapor within the associated chamber and the pressure of the liquid/vapor minimized.

With reference now to the drawings, and in particular to FIG. 1 thereof, a new and improved liquid/vapor cycle embodying the principles and concepts of the present invention and generally designated by the reference numeral 10 will be described.

The present invention, the new and improved liquid/vapor cycle, is comprised of a plurality of components. Such components in their broadest context include a temperature differential, a chamber with working fluid taking the form of liquid/vapor. Such components are individually configured and correlated with respect to each other so as to attain the desired objective.

More specifically, it will be noted that the system of the present invention includes a closed cycle heat engine which may take any form with a conventional heat exchanger capable of taking on a first temperature and a second temperature. Next provided is a chamber with liquid/vapor therein which acts as a working fluid. In use, the heat exchanger is adapted for subjecting the chamber to the first temperature and the second temperature in a reciprocating manner. This reciprocation of temperature effects a change in pressure which may in turn be used to move a piston, diaphragm or the like such that energy may be harnessed and work output generated.

The process associated with the present invention entails first providing the forgoing components. Further, the process includes the act of selecting a working fluid liquid/vapor with desirable characteristics based on the given temperature differential. In other words, it is desirable to select a liquid/vapor that affords an optimum pressure differential which corresponds to the temperature differential, thereby rendering an optimum amount of work.

It is readily apparent given the foregoing discussion that the selection of the working fluid liquid/vapor can be tailored to any given application. In other words, a liquid/vapor may be selected to afford a desired point at which the desired pressure is achieved for a given temperature change within the given application. This is accomplished by using a fluid with the correct vapor pressure characteristics.

For example, given an application or environment with a modest temperature differential and a given lower temperature of 82 degrees, a user may select a working fluid accordingly. Given the modest temperature differential and starting temperature, a user may be inclined to select refrigerant R123 which has a boiling temperature of 82 degrees F and has a vapor pressure which changes with a modest change in temperature. Note FIG. 4 which is a P vs. T table of refrigerant R123. From a review of such graph, it becomes evident that a significant pressure increase is available for modest temperature changes. For example, with the given starting temperature of 82 degrees F and an ending temperature of 140 degrees F., a change in vapor pressure of about 27 psig is exhibited, a considerable amount to say the least.

In yet another example, a succession of engines tailored in accordance with the foregoing principles may be provided on a pair of heat sources one of which is high and one of which is low. In such example, the working fluid liquid/vapor of each subsequent engine may be tailored to accommodate the drop in temperature of the heat sources due to the previous engine. As such, the pressure change resulting from the changing temperatures may be maintained constant or have any desired characteristics.

Figure 2:
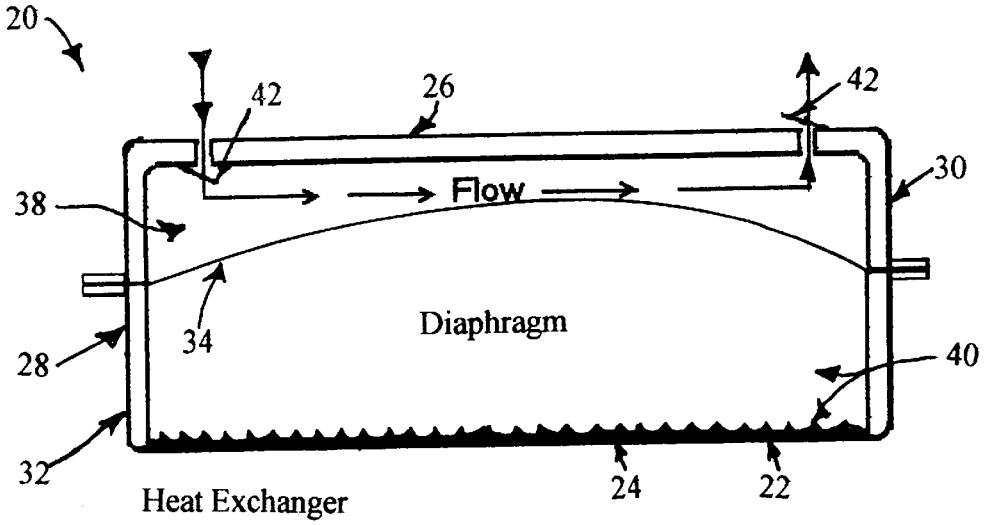
FIG. 2 is a front cross-sectional view of a pump embodiment of the present invention with heat being received by the liquid/vapor within the associated chamber and the pressure of the liquid/vapor maximized.

As a first example of an application of the foregoing apparatus and process, a pump 20 is shown in FIGS. 1 & 2. As shown, a working chamber 22 is provides including a bottom face 24 constructed from a heat conductive material. Further provided is a top face 26 and a peripheral side wall 28. Such peripheral side wall is coupled between the bottom face and the top face and extends therebetween for defining an interior space. For reasons that will soon become apparent, it is imperative that the peripheral side wall have an upper extent 30 constructed from a heat insulative material and a lower extent 32 constructed from the heat conductive material.

Next provided as a component of the pump embodiment is a flexible, elastic diaphragm 34 constructed from the heat insulative material. A periphery of the flexible, elastic diaphragm is connected to an inner surface of the working chamber between the upper extent of the side wall and the lower extent of the side wall of the working chamber. By this structure, an upper subchamber 38 and a lower subchamber 40 are defined which is hermetically sealed.

Mounted on the top face of the working chamber is a pair of valves 42. These valves include a first valve for only allowing fluid to exit the upper subchamber. Associated therewith is a second valve for only allowing fluid to enter the upper subchamber.

Shown very generally in the Figures is a heat exchanger for subjecting the bottom face of the working chamber to a first temperature and a second temperature in a reciprocating manner. As set forth hereinabove, the first temperature and the second temperature are different to define a temperature differential.

Finally, a liquid/vapor 46 is situated within the lower subchamber. It is important that the liquid/vapor have a volume less than that of the lower subchamber such that a pressure of the liquid/vapor varies in order to bias the diaphragm in a reciprocating manner, as shown, for pumping fluid between the first and second valves.

Still yet another embodiment 48 of the present invention is shown in FIG. 3. Such embodiment is of a more complex design in that it includes a means of employing the work generated to reciprocate the liquid/vapor between the first and second temperature source.

In particular, the present embodiment of the present invention includes a pair of dual temperature containers 50 which are laterally situated with respect to each other. The temperature containers are isolated with respect to each other via a heat insulator. The temperature containers are filled to the brim with liquid that is maintained at the first and second temperatures, respectively. Each container has an open top which resides in a common horizontal plane. In operation, the chamber is slidably positioned over the open tops of the containers. Next provided is a chamber 52, as set forth hereinabove in the pump embodiment.

With continuing reference to FIG. 3, a piston assembly 56 is positioned on a recipient surface adjacent the containers and chamber. The piston assembly includes a housing 58 having a bottom face with a peripheral side wall extending upwardly therefrom to define an interior space. A piston plate 60 is slidably situated within the interior space of the housing. It is important that a seal exist between the piston plate and the peripheral side wall of the housing. The piston assembly further includes an arm 62 having a lower end pivotally coupled to the piston plate and extending upwardly therefrom. Lastly, a flexible conduit 64 has a first end coupled to the top face of the chamber and the bottom face of the housing of the piston assembly for affording fluidic communication therebetween.

The present embodiment further includes a flywheel 66 pivotally mounted about a horizontal axis above the piston assembly and further in perpendicular relationship with an axis along which the chamber slides. The supporting assembly of the flywheel has been deleted for purposes of clarity. The flywheel has a crank 68 with an inboard end fixed to a center thereof and an outboard end pivotally coupled to an upper end of the arm. Finally, the flywheel includes a displacer connecting link 69 with a first end pivotally and eccentrically coupled to the flywheel and a second end pivotally coupled to the top face of the chamber. For reasons critical to the use of the present embodiment, it is imperative that the displacer connecting link is connected to the flywheel such that when the same is horizontally positioned, the crank is vertically positioned.

During use, the chamber moves along its horizontal axis, thereby being subjected to the first and second temperature sources in a reciprocating manner. This effects a transfer of fluid between the upper subchamber of the chamber and the housing of the piston assembly, in a manner similar to the previous pump embodiment. This action imparts up and down movement of the arm. Such up and down movement of the arm, in turn, rotates the crank and the flywheel. The cycle is complete with the rotation of the flywheel initiating movement of the chamber in an opposite direction. By this operation, the rotation movement of the flywheel may be harnessed to undergo work. It is important to appreciate the critically of foregoing structure which affords an isolation between the working liquid/vapor and the transfer fluid residing in the upper subchamber and the housing of the piston assembly. By this structure, heat loss is minimized and work output is maximized.

It is imperative to note that the principles set forth hereinabove in each of the foregoing embodiments may be applied to any type of engine(rotary or any other) in any type of application in any type of environment. Further uses of the foregoing cycle include, but are not limited to, the harnessing of low to moderate thermal energy in the formed of solar geothermal, waste heat, naturally occurring sources such as ocean thermal currents, temperature differences of air vs. water, hot air vs. cold air, hot water vs. cold water, etc.

As to the further manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A liquid/vapor cycle engine comprising:

a working chamber including a bottom face constructed from a heat conductive material, a top face, and a peripheral side wall coupled between the bottom face and the top face and extending therebetween for defining an interior space, the peripheral side wall having an upper extent constructed from a heat insulative material and a lower extent constructed from the heat conductive material;

a flexible, elastic diaphragm constructed from the heat insulative material with a periphery connected to an inner surface of the working chamber between the upper extent of the side wall and the lower extent of the side wall of the working chamber for defining an upper subchamber and a lower subchamber which is hermetically sealed;

a pair of valves mounted on the top face of the working chamber including a first valve for only allowing fluid to exit the upper subchamber and a second valve for only allowing fluid to enter the upper subchamber;

a heat exchanger for subjecting the bottom face of the working chamber to a first container of a first temperature and a second container of a second temperature in a reciprocating manner, wherein the first temperature and the second temperature are different to define a temperature differential; and means for reciprocating the working chamber between the first and second containers;

a liquid/vapor situated within the lower subchamber, the liquid/vapor having a volume less than that of the lower subchamber such that a pressure of the liquid/vapor varies in order to bias the diaphragm in a reciprocating manner for pumping fluid between the first and second valves.

2. The engine as described in claim 1 further comprising:

a piston assembly in fluid communication with the working chamber such that a transfer of fluid from the upper subchamber effects the movement of the piston.

3. The engine as described in claim 2 further comprising:

a flywheel which is mechanically coupled to the piston assembly such that movement of the piston effects rotation of the flywheel.

4. The engine as described in claim 3 further comprising:

a displacer connecting link coupling the flywheel and the means for reciprocating the working chamber such that rotation of the flywheel effects movement of the working chamber.

* * * * *